US008119201B2

(12) United States Patent
Present

(10) Patent No.: US 8,119,201 B2
(45) Date of Patent: Feb. 21, 2012

(54) PALETTE KNIVES AND PAINTING TOOLS

(75) Inventor: Scott D. Present, Piscataway, NJ (US)

(73) Assignee: Colart Americas, Inc. NJ (US)

( * ) Notice: Subject to any disclaimer, the term of this patent is extended or adjusted under 35 U.S.C. 154(b) by 413 days.

(21) Appl. No.: 12/033,880

(22) Filed: Feb. 19, 2008

(65) Prior Publication Data

US 2008/0145529 A1 Jun. 19, 2008

Related U.S. Application Data

(60) Provisional application No. 60/909,927, filed on Apr. 3, 2007.

(51) Int. Cl.
*B05D 3/12* (2006.01)

(52) U.S. Cl. ..... 427/358; 7/105; 15/236.01; 15/245.1; 427/285; 427/355; 427/356; 427/411

(58) Field of Classification Search ..... 427/356, 427/285, 355, 357, 411; 7/105, 110, 113; 15/235.4, 235.5, 235.7, 235.8, 236.01, 236.07, 15/245.1

See application file for complete search history.

(56) References Cited

U.S. PATENT DOCUMENTS 4,078,949 A * 3/1978 Boggs et al. ..... 148/286
2004/0000739 A1* 1/2004 Perlman ..... 264/109

OTHER PUBLICATIONS http://web.archive.org/web/20040218002733/http://www.candylandcrafts.com/SpatulasAteco.htm (published on or before May 3, 2006), last accessed May 26, 2010.* http://www.candylandcrafts.com/SpatulasAteco.htm, last accessed May 26, 2010.* http://web.archive.org/web/20060422043237/www.atecousa.net/Merchant2/merchant.mvc?Screen=CTGY&Category_Code=spa t, last accessed May 26, 2010.*

"Painting Techniques: Sgraffito". pp. 1-2. http://web.archive.org/web/20060207124905/http:// painting.about.com/od/paintingforbeginners/ss/Sgraffito.htm and http://web.archive.org/web/20060618134509/ http:// painting.about.com/od/paintingforbeginners/ss/Sgraffito_2.htm. (captured Jun. 18,2006 and Feb. 7, 2006, last viewed Oct. 6, 2011).*

* cited by examiner

*Primary Examiner* — Michael Cleveland
*Assistant Examiner* — Alexander Weddle
(74) *Attorney, Agent, or Firm* — McNeely, Hare & War LLP; William D. Hare, Esq.

(57) ABSTRACT

The invention relates to a painting tool and method of use for manipulating painting material on a painting surface. The method includes providing the tool, which includes a handle and blade. The blade is made of a resilient metal, has a matted surface, and includes handle, middle and distal sections. The handle section has a first end positioned within the middle third of the handle and a second end connected to the middle section. The middle section connects at a first end to the handle section and at a second end to the distal section. The distal section extends from the middle section and is in a distal section plane offset from the handle section. The distal section plane is at an angle to the handle section plane. The distal section is used to take a painting material and place and manipulate the painting material onto a painting surface.

5 Claims, 10 Drawing Sheets

PALETTE KNIVES AND PAINTING TOOLS

TECHNICAL FIELD

The field of the invention generally relates to palette and painting knives used by artists in painting.

BACKGROUND

Artists use knives in painting for a variety of reasons, including to provide a texture to the painting. Artists traditionally have relied upon the tools developed in other industries in their painting. Unfortunately, most of these tools have been designed for specific uses in those other industries and may not be optimized for artist' use. For example, the most common artist' knives have been taken from the cake industry, where they are used to spread icing, and the construction industry, where they have been used to spread mortar.

SUMMARY

In one general aspect a painting tool includes a handle and a blade. The blade is made of a resilient metal material, has a matted surface, and includes a handle section, a middle section, and a distal section. The handle section has a first end and a second end, the first end being positioned within the middle third of the length of the handle and the second end being connected to the middle section. The middle section connects at a first end to the handle section and forms an angle of between approximately 130 and 150 degrees with the handle section and connects at a second end to the distal section and forms an angle of between approximately 110 and 130 degrees with the distal section. The distal section extends from the middle section and is in a distal section plane that is offset from a handle section plane containing the handle section by between approximately 1.5 and 5 cm. The distal section plane is at an angle of between approximately 3 and 10 degrees to the handle section plane.

Embodiments of the painting tool may include one or more of the following features. For example, the handle section of the blade may extend into the handle approximately half the length of the handle.

The metal may be stainless steel 3CR13 or other similar stainless steel or metal. The blade may have a variable thickness that is thicker near the handle and becomes progressively thinner in the direction of the tip of the blade. For example, the thickness near the handle may be approximately 0.040 inches to 0.050 inches, and more particularly approximately 0.044 inches to 0.046 inches. The thickness may be reduced in the direction of the tip and may reach a thickness of approximately 0.010 inches to 0.032 inches, and more particularly 0.014 inches to 0.030 inches. Blades of this metal and thickness provide a flexibility that allows the artist to have an optimized degree of control over the tool and painting media when applying various painting techniques.

The distal section plane may be at an angle of between approximately 3 and 7 degrees to the handle section plane. The distal section plane may be at an angle of approximately 5 degrees to the handle section plane. The offset between the distal section plane and the handle section plane may be between approximately 2 and 3 cm.

The middle section forms an angle of between approximately 137 and 143 degrees with the handle section and the handle section forms an angle of between approximately 115 and 125 degrees with the distal section.

The distal section of the blade may include right angled corners. The distal section of the blade may include two curved corners. The distal section of the blade may include four curved corners.

The distal section may include a curved tip. The distal section may further include two curved corners adjacent to the middle section and have a generally triangular shape. The distal section also may further comprise an angled corner.

The distal section may include three angled corners. The distal section may include two curved sides extending from the middle section at first ends and forming a pointed tip at second ends.

In another general aspect, a method of painting includes providing a painting tool and using the painting tool to take a painting material and place the painting material onto a painting surface. The painting tool includes a handle and a blade, the blade being of a resilient metal material, having a matted surface, and including a handle section, a middle section, and a distal section. The handle section has a first end and a second end, the first end being positioned within the middle third of the length of the handle and the second end being connected to the middle section. The middle section connects at a first end to the handle section and forms an angle of between approximately 130 and 150 degrees with the handle section and connects at a second end to the distal section and forms an angle of between approximately 110 and 130 degrees with the distal section. The distal section extends from the middle section and is in a distal section plane that is offset from a handle section plane containing the handle section by between approximately 1.5 and 5 cm and the distal section plane being at an angle of between approximately 3 and 10 degrees to the handle section plane.

Embodiments of the method of painting may include one or more of the following aspects or those described above. For example, placing the painting material onto a painting surface may include one or more of scraping, scumbling, mixing, sculpting, spreading, sgraffito, dragging, linework, incising, and scratching.

Using the painting tool to take a painting material and place the painting material onto a painting surface may include placing one or more of wet paint, dry paint, wet gels, dry gels, aggregates, wet plaster, and dry plaster on the painting surface.

The details of various embodiments of the painting tools and methods are set forth in the accompanying drawings and the description below. Other features and advantages of the invention will be apparent from the description, the drawings, and the claims.

DETAILED DESCRIPTION

Figure 1:
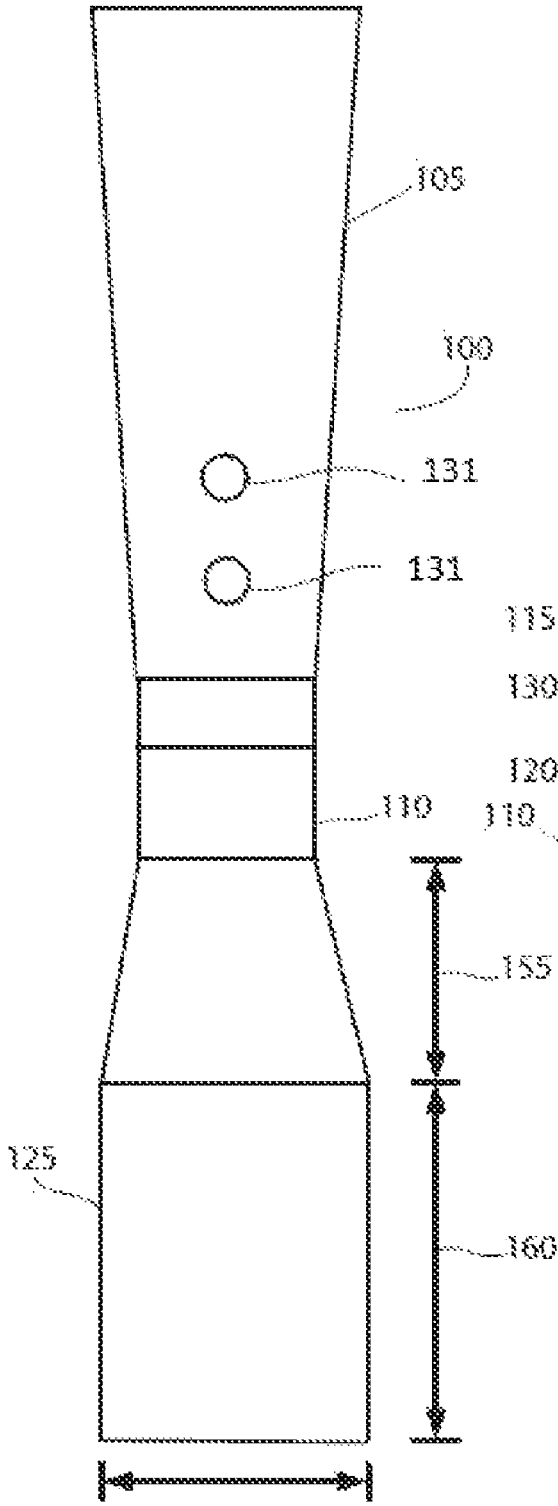
FIGS. 1 and 2 are top and side views, respectively, of a scraping tool.

The inventors have developed a range of paletting and painting knives that have been designed with optimized features for artist use. The knives can be divided into scraper painting tools, painting spatulas, and trowel painting tools.

The scraper painting tools are strong and stiff, yet sufficiently resilient for scraping, scumbling, mixing, sculpting, and spreading materials. The techniques that can be used with the scraper painting tools include spreading, sgraffito, dragging, scumbling, linework, incising, scratching, and mixing. The applications to which they can be applied include wet paint, dry paint, wet gels, dry gels, aggregates, wet plaster, and dry plaster.

The painting spatulas are generally flexible with resilient, blunt, rounded-edged extra long blades. The techniques that can be used with the spatula tools include spreading, scumbling, smoothing, smudging, mixing, pre-mixing paint, collage, transfers, creation of stroke direction. The applications to which they can be applied include gesso, paint, modeling paste and texture gels.

The trowel painting tools have flexible or stiff and square or rounded-edged trowel blades that are advantageous for mixing and spreading paint, texture gels, and other media. They are used to shape, stroke, build up or scrape away material from the surface.

The various tool embodiments described herein optionally may have one or more of the following features or characteristics. The knives may have brushed stainless steel blades that resist corrosion and wear from most media, in particular such media as the paints used by artists. The blades may have a matted surface designed to prevent a distracting or uncomfortable glare that can reflect from the blade when, for example, painting in the outdoors where the sun is bright or indoors if the lighting is bright. The handle may be made of wood, for example birch, the paint used on the handle may be a matt polyester, and the rivets may be the same metal as the blade (e.g., stainless steel 3CR13) or a different metal.

For an economic advantage, the blades have been designed to extend into the handle only into between one third to two thirds of the length of the handle, and specifically one half of the length of the handle. Typically, blades extend fully into the handle for the entire length of the handle. By reducing the length of the blade that extends into the handle, this design provides a cost reduction compared to a blade that extends completely into the entire length of the handle.

As described in more detail below, the blades can extend from the handle and include one or more bends, curves or angles in the proximity of the handle such that the working end of the blade is in a plane that is offset but approximately parallel to the handle. For example, the plane of the working end of the blade can be in a plane that is at an angle of between 0 and 10 degrees to the handle, more particularly between approximately 3 and 10 degrees to the handle, more particularly between approximately 3 and 7 degrees, and more particularly at 5 degrees relative to the handle. The offset can be between approximately 1.5 cm and 5 cm, more particularly between approximately 2 and 3 cm, and even more particularly approximately 2.5 cm.

By appropriately selecting the bends, curves or angles, and length of the blade that extends from the handle to the working end of the blade, the offset can be controlled an optimized to reduce the likelihood that the artist will have his/her hands or knuckles contacting the painting surface during use of the tool. This selection also creates an ergonomically optimized knife that reduces the stresses and strains on the artist's handles, wrists, arms and back by allowing the artist to use the tool in a more comfortable and natural manner. The details of this optional feature and those optional features described above are described in more detail below.

Figure 2:
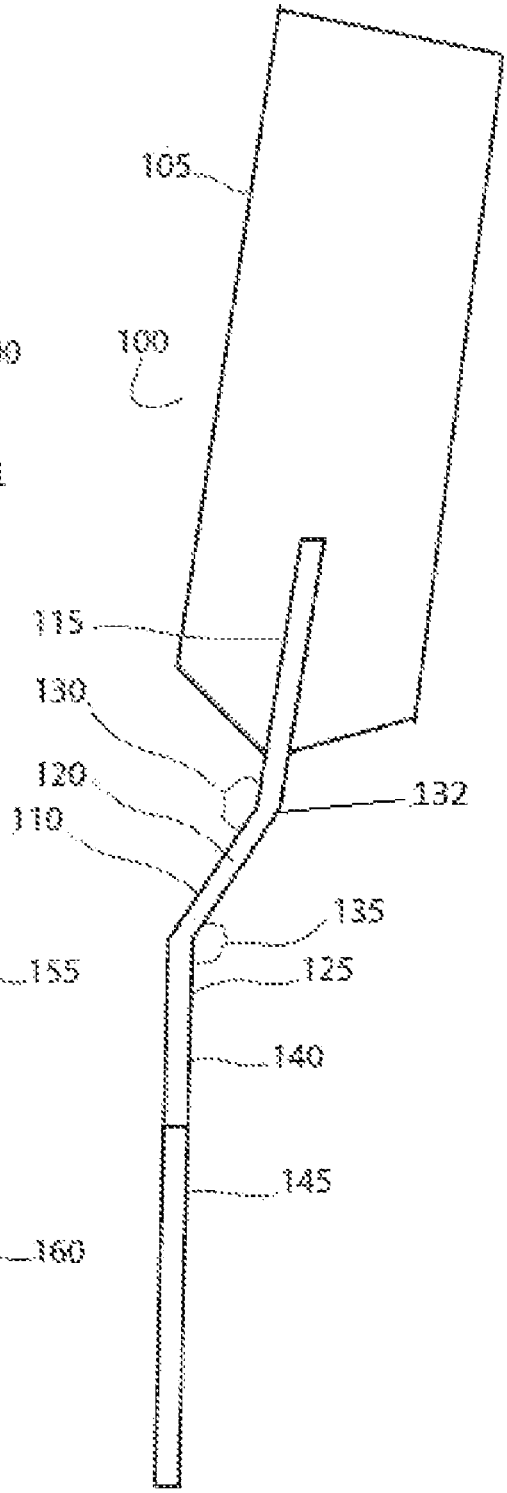

Referring to FIGS. 1 and 2, a painting scraper tool 100 is illustrated. The tool 100 includes a handle 105 and a blade 110 having three sections: a handle section 115, a middle section 120, and a distal section 125. The handle section and the middle section intersect at a joint 132. The handle section 115 extends into the handle 105 approximately half the length of the handle, although the length can extend into the handle between approximately one third and two thirds the length of the handle. The handle section is fixed in place within the handle by two or more rivets 131. By extending into the handle section less than the entire length of the handle section, as is the norm, the blade 110 can be made from less metal, thereby reducing material costs without adversely impacting the use of the tool.

The middle section 120 of the blade is at an angle 130 to the handle section 115 and the distal section 125 is at an angle 135 to middle section 120. In one implementation, the length of the middle section is between approximately 3 cm and 5 cm and forms the angle 130 of between approximately 130 and 150 degrees with the handle section, more particularly between approximately 137 and 143 degree, and even more particularly approximately 140 degrees. The distal section 125 extends from the middle section and is in an almost parallel plane to the handle section and forms the angle 135 of between approximately 110 and 130 degrees with the middle section, more particularly between approximately 115 and 125 degrees, and even more particularly approximately 120 degrees. In one implementation, the distal section has a width of approximately 3.5 cm and a length of approximately 8.5 cm.

The combination of the angles 130 and 135 between the middle section and the handle and distal sections, and the length of the middle section, offsets the plane containing the handle from the distal section. This offset allows the painter to use the tool on a painting surface with a significantly reduced likelihood of the painter's hands, knuckles, or fingers contacting the painting surface. This characteristic of the tool is optional and may be present on all the tools described herein.

The distal section 125 of the blade has a connecting portion 140 and a scraping portion 145. The connecting portion 140 extends from the middle section 110 to the scraping portion 145 and expands from a first width at the middle section to a second width 150 at the scraping portion, with the first width being less than the second width. The connecting portion 140 has a length 155 and the scraping portion 145 has a length 160. The width 150 and the lengths 155, 160 all can be varied according to the application or use of the particular implementation. For example, in one particular implementation the width 150 is between 3 and 4 cm, more particularly between approximately 3.3 and 4.7 cm, and more particularly approximately 3.5 cm. In one implementation the length 155 of the connecting portion 140 is between approximately 3 and 4 cm, more particularly between approximately 3.3 and 3.7 cm, and more particularly 3.5 cm. In one implementation the length 160 of the scraping portion 145 is between approximately 5 and 6 cm, more particularly between approximately 5.3 and 5.7 cm, and more particularly 5.5 cm. In other implementations, the length 160 can be as long as 12 to 22 cm, depending upon artist preference and need.

The scraping portion 145 also can be varied based on the side and distal edge configurations. For example, FIGS. 1 and 2 illustrate the side edges and distal edge each being straight. In other implementations the distal edge can be serrated, notched, or otherwise fabricated to have different configurations that give a particular effect when scraping or spreading paint. In particular, a serrated edge is useful in spreading acrylic paints. Similarly, one or both of the side edges can have a serrated edge along a portion of its length, or the entire length. If the distal edge and one of the side edges are serrated, or otherwise fabricated to have a straight edge or different configuration, an artist advantageously can use one tool to create different effects on the painting surface without needing to switch tools. For example, a downward sweep may emphasize the serrated edge while an upward sweep may emphasize the straight edge. The tool has been characterized as allowing the artist to make staccato marks. It also can be used to leave a ruffled "potato chip look" with every stroke, and one of the sides may be serrated as well.

As described above with respect to the selection of the choice of metal, thickness and flexibility, the resilience of the blade is optimized for spreading the painting material on the painting surface.

Figure 3:
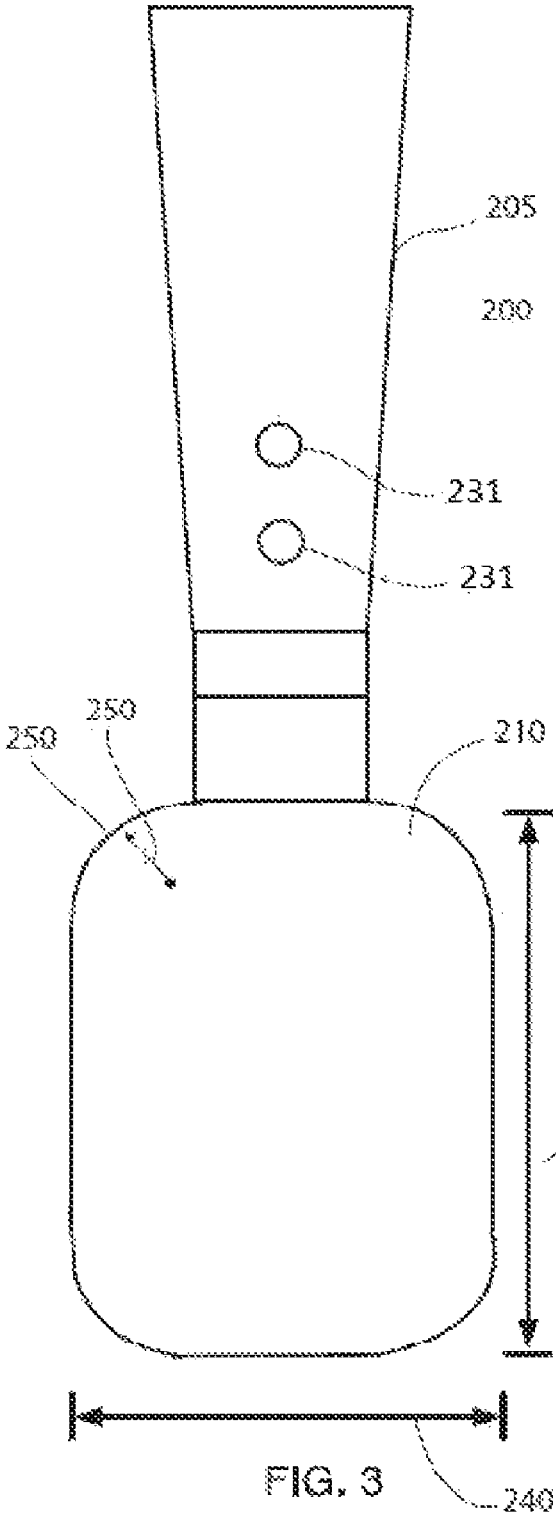
FIGS. 3 and 4 are top and side views, respectively, of a rounded plate painting spatula tool.
Figure 4:
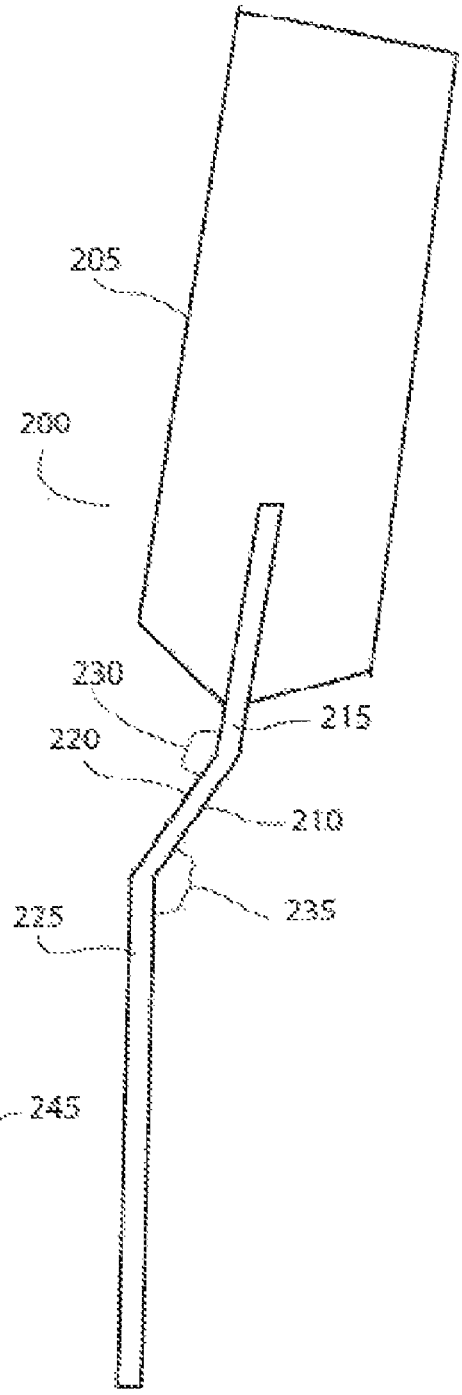

Referring to FIGS. 3 and 4, a rounded plate painting spatula tool 200 is illustrated. The tool 200 includes a handle 205 and a blade 210 having a handle section 215, a middle section 220, and a distal section 225. The handle section 215 extends into the handle 205 approximately half the length of the handle and is fixed in place within the handle by two or more rivets 231. The middle section 220 of the blade is at an angle 230 to the handle section 215 and the distal section 225 is at an angle 235 to middle section 220. In one implementation, the length of the middle section is approximately 3 cm and forms the angle 230 of between approximately 130 and 150 degrees with the handle section, more particularly between approximately 137 and 143 degree, and even more particularly approximately 140 degrees. The distal section 225 extends from the middle section and is in an almost parallel plane to the handle section and forms the angle 235 of between approximately 110 and 130 degrees with the middle section, more particularly between approximately 115 and 125 degrees, and even more particularly approximately 120 degrees. In one implementation, the distal section has a width 240 of approximately 5 cm and a length 245 of approximately 7 cm. In another implementation the distal section has a width 240 of approximately 7 cm and a length 245 of approximately 9 cm. Although these dimensions are provided for two implementations, other dimensions are contemplated, such as a width of approximately 5 cm and a length of between 9 and 22 cm. In general, these dimensions can be varied according to artist preference.

The combination of the angles 230 and 235 between the middle section and the handle and distal sections, and the length of the middle section, offsets the plane containing the handle from the distal section. This offset allows the painter to use the tool on a painting surface with a significantly reduced likelihood of the painter's hands, knuckles, or fingers contacting the painting surface.

The distal section 225 of the blade has four rounded corners 250, each having a radius 255. For example, the radius 255 can be in the range of between 3 and 5 cm, more particularly between approximately 3.5 and 4.5 cm, and most particularly approximately 4 cm. In other implementations, the radius 255 can be in the range of between 5 and 7 cm, more particularly between approximately 5.5 and 6.5 cm, and most particularly approximately 6 cm. The rounded corners 255 are used when making strokes on a painting surface and advantageously provide a smooth transition between the paint being manipulated with the blade and the adjacent paint. For example, a right-angled corner is likely to leave a sharp demarcation between the paint being manipulated and the adjacent paint.

Variations in the rounded corners 250 and the edges are contemplated. For example, each of the corners 250 can have a different radius or can be configured in pairs with each pair having a different radius. Either the distal pair may have a first radius and the proximal pair a second radius or the left side pair may have a first radius and the right side pair a second radius.

The distal section 225 can also be varied by side and distal edge configurations. For example, FIGS. 3 and 4 illustrate the side edges and distal edge each being straight. In other implementations the distal edge can be serrated, notched, or otherwise fabricated to have different configurations that give an effect when scraping or spreading paint. In particular, a serrated edge is particularly useful in spreading acrylic paints. Similarly, one or both of the side edges can have a serrated edge along a portion of its length, or the entire length. If the distal edge and one of the side edges are serrated, or otherwise fabricated to have a straight edge or different configuration, an artist advantageously can use one tool to create different effects on the painting surface without needing to switch tools. Like the side edges and distal edges, the rounded corners 250 also can have different edge configuration to create different effects on the painting surface. Just as the rounded corners each can have a different radius, each rounded corners 250 also can have a different edge configuration.

Figure 5:
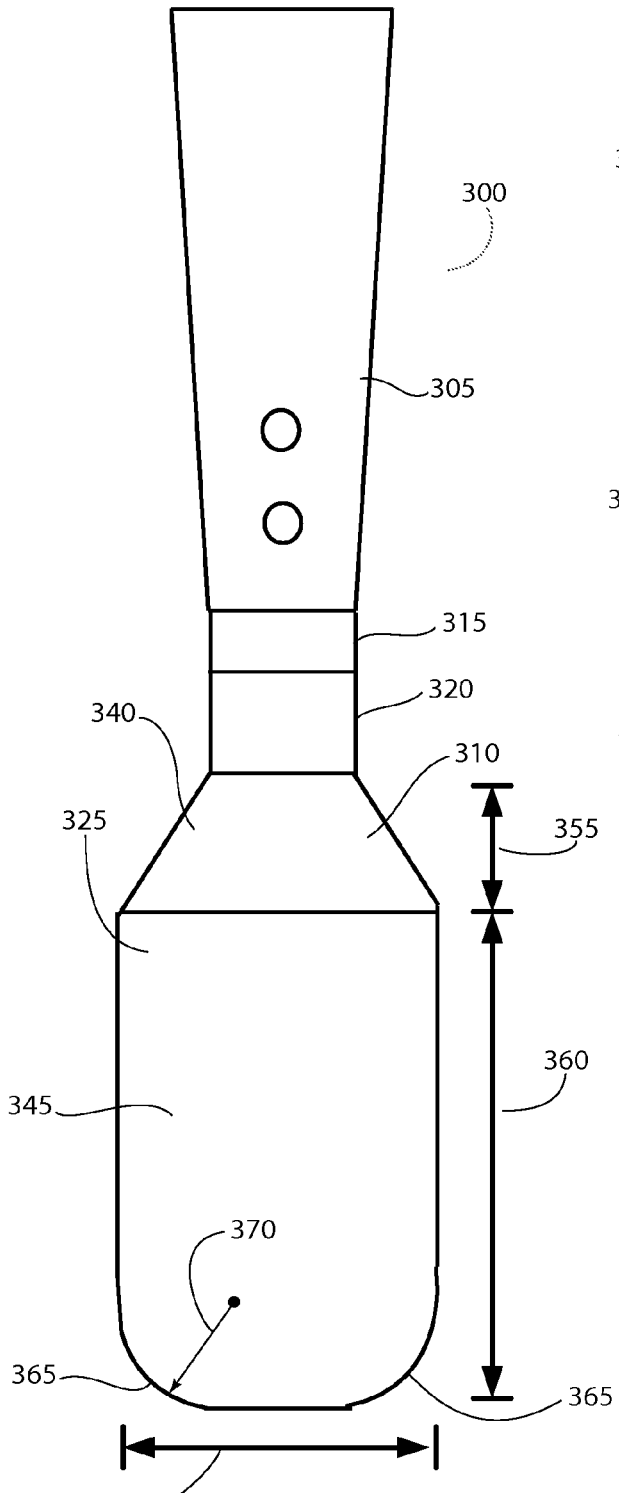
FIGS. 5 and 6 are top and side views, respectively, of a rounded blade painting spatula tool.
Figure 6:
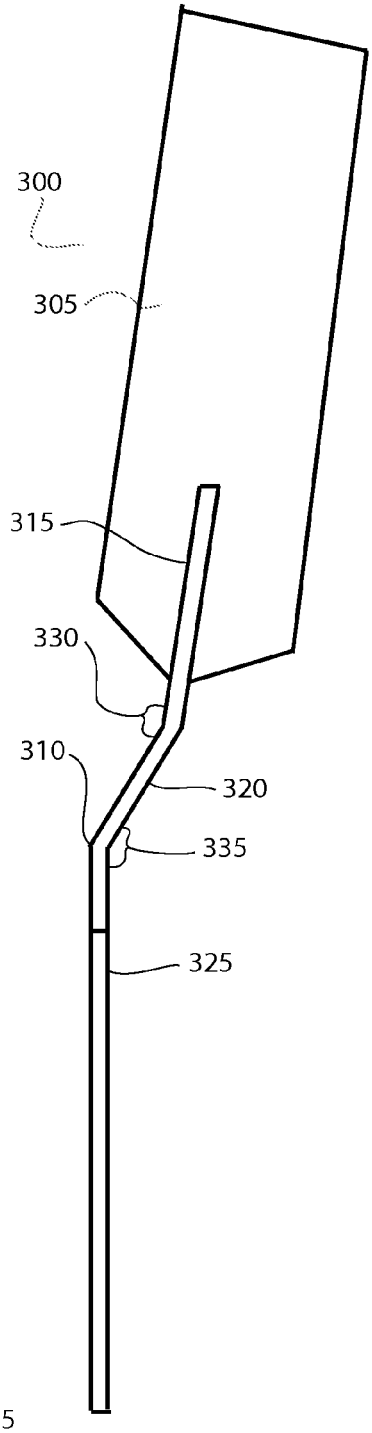

Referring to FIGS. 5 and 6, a rounded blade painting scraper tool 300 is illustrated. The tool 300 includes a handle 305 and a blade 310 having a handle section 315, a middle section 320, and a distal section 325. The handle section 315 extends into the handle 305 approximately half the length of the handle. The handle section is fixed in place within the handle by two or more rivets. The middle section 320 of the blade is at an angle 330 to the handle section 315 and the distal section 325 is at an angle 335 to middle section 320. In one implementation, the length of the middle section is approximately 3 cm and forms the angle 330 of between approximately 130 and 150 degrees with the handle section, more particularly between approximately 137 and 143 degree, and even more particularly approximately 140 degrees. The distal section 325 extends from the middle section and is in an almost parallel plane to the handle section and forms the angle 335 of between approximately 110 and 130 degrees with the middle section, more particularly between approximately 115 and 125 degrees, and even more particularly approximately 120 degrees. In one implementation, the distal section has a width of approximately 4 cm and a length of approximately 10.5 cm. In another implementation, the distal section has a width of approximately 4 cm and a length of approximately 22 cm. In another implementation, the distal section has a width of approximately 3 cm and a length of approximately 17 cm.

The combination of the angles 330 and 335 between the middle section and the handle and distal sections, and the length of the middle section, offsets the plane containing the handle from the distal section. This offset allows the painting to use the tool on a painting surface with a significantly reduced likelihood of the painter's hands, knuckles, or fingers contacting the painting surface.

The distal section 325 of the blade has a connecting portion 340 and a spatula portion 345. The connecting portion 340 extends from the middle section 310 to the scraping portion 345 and expands from a first width at the middle section to a second width 350 at the scraping portion, with the first width being less than the second width. The connecting portion 340 has a length 355 and the spatula portion 345 has a length 360. The width 350 and the lengths 355, 360 all can be varied according to the use of the particular implementation. For example, in one particular implementation the width 350 is between 2 and 4 cm, more particularly between approximately 2.7 and 3.3 cm, and more particularly approximately 3 cm. In another implementation the width 350 is between approximately 3 and 5 cm, more particularly between approximately 3.7 and 4.3 cm, and more particularly approximately 4 cm. In another implementation the length 355 of the connecting portion 340 is between approximately 3 and 4 cm, more particularly between approximately 3.3 and 3.7 cm, and more particularly approximately 3.5 cm. In one implementation the length 360 of the spatula portion 345 is between approximately 9 and 12 cm, more particularly between approximately 10 and 11 cm, and more particularly 10.5 cm. In other implementations, the length 360 can be as long as 12 to 25 cm, e.g., 17 cm, 22 cm, etc., depending upon artist preference or need.

The distal section 345 of the blade has two rounded corners 365, each having a radius 370. For example, the radius 370 can be in the range of between 3 and 5 cm, more particularly between approximately 3.5 and 4.5 cm, and most particularly approximately 4 cm. In other implementations, the 370 can be in the range of between 2 and 4 cm, more particularly between approximately 2.5 and 3.5 cm, and most particularly approximately 3 cm. The rounded corners 365 are used when making strokes on a painting surface and advantageously provide a smooth transition between the paint being manipulated and the adjacent paint. For example, a right angled corner is likely to leave a sharp demarcation between the paint being manipulated and the paint adjacent to it. Variations in the rounded corners 365 and the edges are contemplated. For example, each of the corners 370 can have a different radius or the same radius.

The spatula section 345 can also be varied by side and distal edge configurations. For example, FIGS. 5 and 6 illustrate the side edges and distal edge each being straight. In other implementations the distal edge can be serrated, notched, or otherwise fabricated to have different configurations that give an effect when scraping or spreading paint. In particular, a serrated edge is particularly useful in spreading acrylic paints. Similarly, one or both of the side edges can have a serrated edge along a portion of its length, or the entire length. If the distal edge and one of the side edges are serrated, or otherwise fabricated to have a straight edge or different configuration, an artist advantageously can use one tool to create different effects on the painting surface without needing to switch tools. Like the side edges and distal edges, the rounded corners 365 also can have different edge configuration to create different effects on the painting surface. Just as the rounded corners each can have a different radius, each rounded corners 370 also can have a different edge configuration. This also provides additional flexibilities to the artist by either reducing the need to switch tools or having the ability to make a greater variety of effects on the painting surface. In addition, as a result of the flexible blade, the tool has the ability to pick up a relatively enhanced quantity of paint and spread it over a large amount of surface area.

Figure 7:
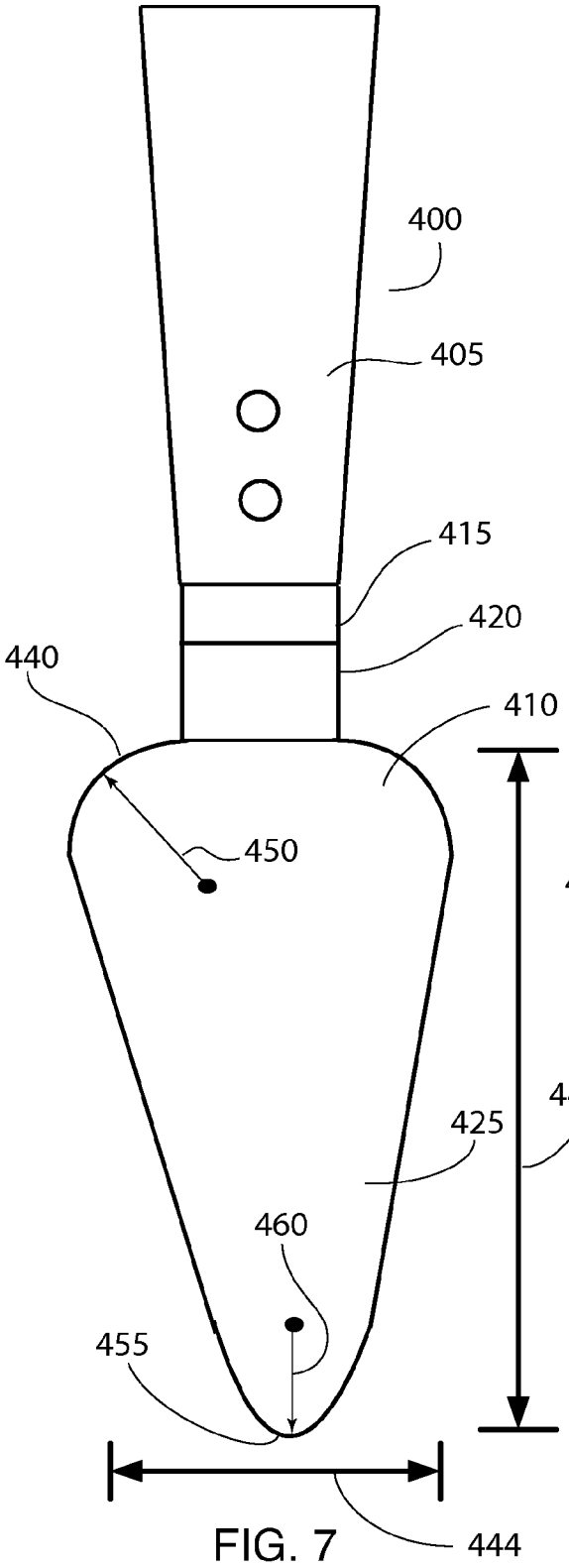
FIGS. 7 and 8 are top and side views, respectively, of a rounded tip painting spatula tool.
Figure 8:
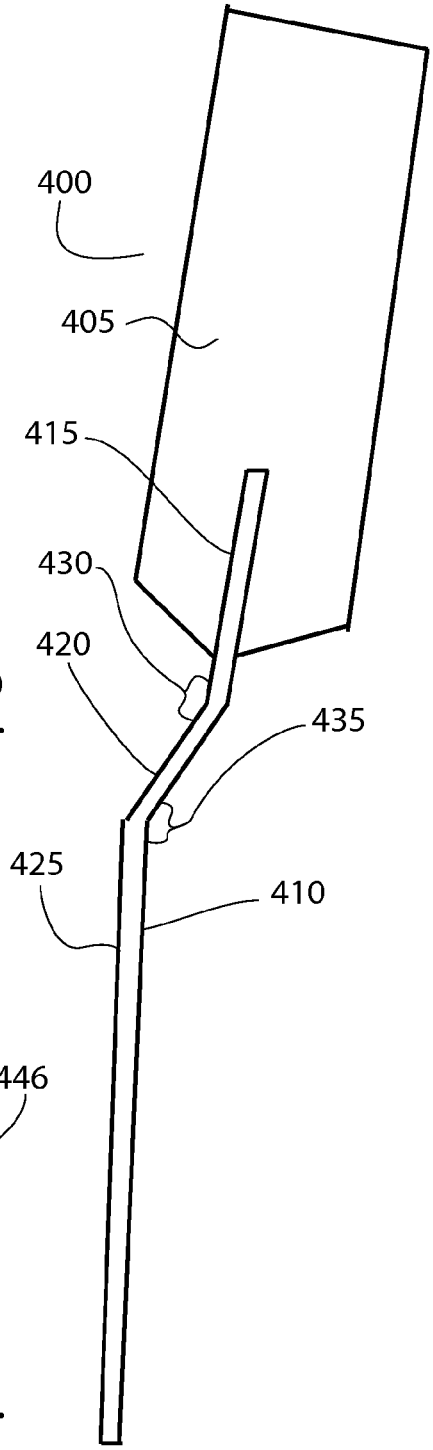

Referring to FIGS. 7 and 8, a rounded tip painting spatula tool 400 is illustrated. The tool 400 includes a handle 405 and a blade 410 having a handle section 415, a middle section 420, and a distal section 425. The handle section 415 extends into the handle 405 approximately half the length of the handle. The middle section 420 of the blade is at an angle 430 to the handle section 415 and the distal section 425 is at an angle 435 to middle section 420. In one implementation, the length of the middle section is approximately 3 cm and forms the angle 430 of between approximately 130 and 150 degrees with the handle section, more particularly between approximately 137 and 143 degree, and even more particularly approximately 140 degrees. The distal section 425 extends from the middle section and is in an almost parallel plane to the handle section and forms the angle 435 of between approximately 110 and 130 degrees with the middle section, more particularly between approximately 115 and 125 degrees, and even more particularly approximately 120 degrees.

The combination of the angles 430 and 435 between the middle section and the handle and distal sections, and the length of the middle section, offsets the plane containing the handle from the distal section. This offset allows the painter to use the tool on a painting surface with a significantly reduced likelihood of the painter's hands, knuckles, or fingers contacting the painting surface.

In one implementation, the distal section has a maximum width 444 of approximately 5 cm and a length 446 of approximately 12 cm. In another implementation the distal section has a width 444 of approximately 4 cm and a length of approximately 11 cm. Although these dimensions are provided for two implementations, other dimensions are contemplated, such as a width of between approximately 3 cm and 6 cm and a length of between approximately 9 cm and 15 cm. In general, these dimensions can be varied according to artist preference.

The distal section 425 of the blade has two rounded corners 440, each having a radius 450. The radius 450 can be in the range of between 3 and 5 cm, more particularly between approximately 3.5 and 4.5 cm, and most particularly approximately 4 cm. The tip 455 is blunt and may have a radius 460 in the range of between 1 and 3 cm, more particularly between approximately 1.5 and 2.5 cm, and most particularly approximately 2 cm. The rounded corners 450 and tip 455 are used when making strokes on a painting surface and advantageously provide a smooth transition between the paint being manipulated and the paint adjacent to it. For example, a right angled corner and tip are likely to leave a sharp demarcation between the paint being manipulated and the adjacent paint.

Variations in the rounded corners 450, tip 455, and the edges are contemplated. For example, each of the corners 450 can have a different radius. The distal section 425 also can be varied by tip, corner, and side edge configurations. For example, FIGS. 7 and 8 illustrate the rounded corners, tip, and side edges each being straight. In other implementations, one or more of the rounded corners, tip, and side edges can be serrated, notched, or otherwise fabricated to have different configurations that give an effect when scraping or spreading paint. In particular, a serrated edge is particularly useful in spreading acrylic paints. Similarly, one or both of the side edges can have a serrated edge along a portion of its length, or the entire length. If the tip, rounded corners, and one of the side edges are serrated, or otherwise fabricated to have a straight edge or different configuration, an artist advantageously can use one tool to create different effects on the painting surface without needing to switch tools.

Figure 9:
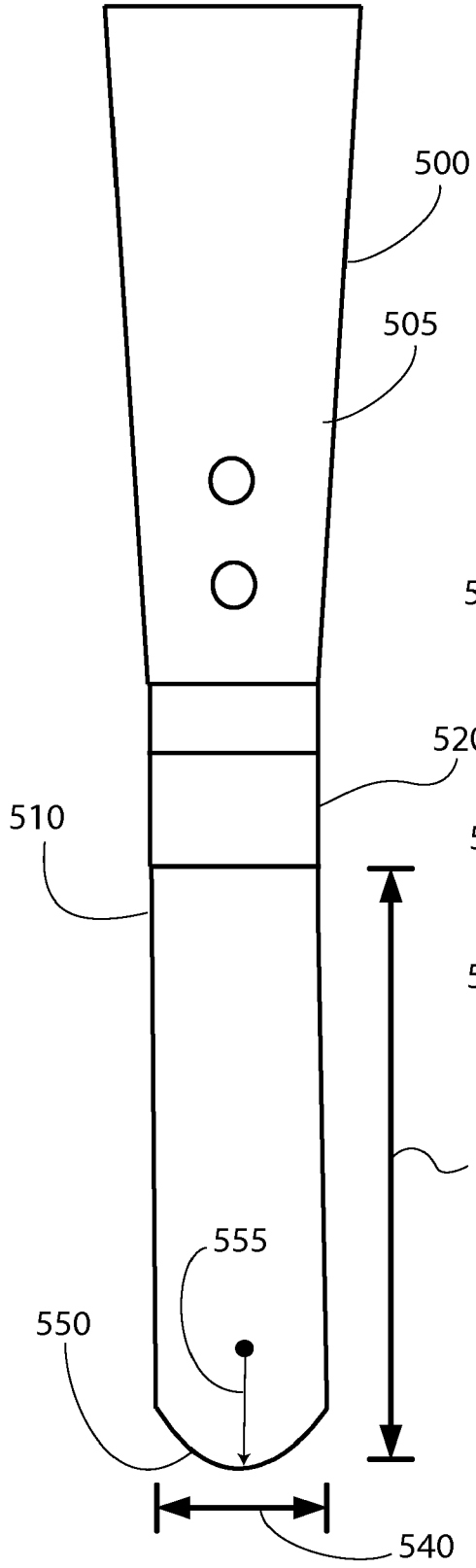
FIGS. 9 and 10 are top and side views, respectively, of a narrow, blunt painting spatula tool.
Figure 10:
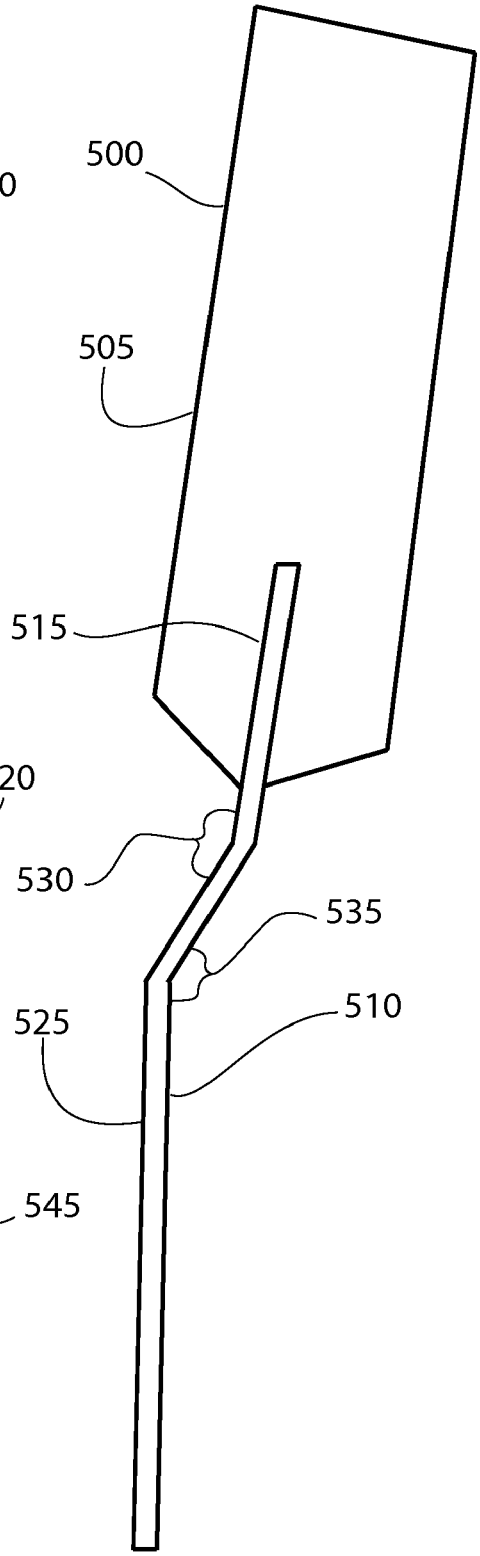

Referring to FIGS. 9 and 10, a narrow, rounded blade painting spatula tool 500 is illustrated. The tool 500 includes a handle 505 and a blade 510 having a handle section 515, a middle section 520, and a distal section 525. The handle section 515 extends into the handle 505 approximately half the length of the handle. The handle section is fixed in place within the handle by two or more rivets. The middle section 520 of the blade is at an angle 530 to the handle section 515 and the distal section 525 is at an angle 535 to middle section 520. In one implementation, the length of the middle section is approximately 3 cm and forms the angle 530 of between approximately 130 and 150 degrees with the handle section, more particularly between approximately 137 and 143 degree, and even more particularly approximately 140 degrees. The distal section 525 extends from the middle section and is in an almost parallel plane to the handle section and forms the angle 535 of between approximately 110 and 130 degrees with the middle section, more particularly between approximately 115 and 125 degrees, and even more particularly approximately 120 degrees.

In one implementation, the distal section has a width 540 of approximately 2 cm and a length 545 of approximately 13 cm. Other dimensions are contemplated, such as between 1 and 3 cm for the width and 7 and 20 cm for the length, depending upon the artist's needs.

The combination of the angles 530 and 535 between the middle section and the handle and distal sections, and the length of the middle section, offsets the plane containing the handle from the distal section. This offset allows the painter to use the tool on a painting surface with a significantly reduced likelihood of the painter's hands, knuckles, or fingers contacting the painting surface. In addition, a larger or medium sized tool according to FIG. 9 has been characterized as having the capability of making good marks, rather than a ridge, during use. The smaller or mini sized tool according to FIG. 9 has been characterized as allowing a good spreading technique, building dense textures and leaving a desirable marks rather than a ridge, as the term is used by painters.

The distal section 525 of the blade has a rounded tip 550 having a radius 555. For example, the radius 555 can be in the range of between 1 and 3 cm, more particularly between approximately 1.5 and 2.5 cm, and most particularly approximately 2 cm. The rounded tip 550 is useful when making strokes on a painting surface and advantageously provides a smooth transition between the paint being manipulated and the paint adjacent to it. For example, a straight, ninety degree corner is likely to leave a sharp demarcation between the paint being manipulated and the adjacent paint. Variations in the rounded tip 540 and the edges are contemplated. For example, the tip can have a radius of approximately 1 to 5 cm. If the radius is increased, the width may be increased and gradually reduced at the tip, or kept the same.

The distal section 525 can also be varied by side and tip edge configurations. For example, FIGS. 9 and 10 illustrate the side edges and tip edge each being straight. In other implementations the tip edge can be serrated, notched, or otherwise fabricated to have different configurations that give an effect when scraping or spreading paint. In particular, a serrated edge is particularly useful in spreading acrylic paints. Similarly, one or both of the side edges can have a serrated edge along a portion of its length, or the entire length. If the tip edge and one of the side edges are serrated, or otherwise fabricated to have a straight edge or different configuration, an artist advantageously can use one tool to create different effects on the painting surface without needing to switch tools.

Figure 11:
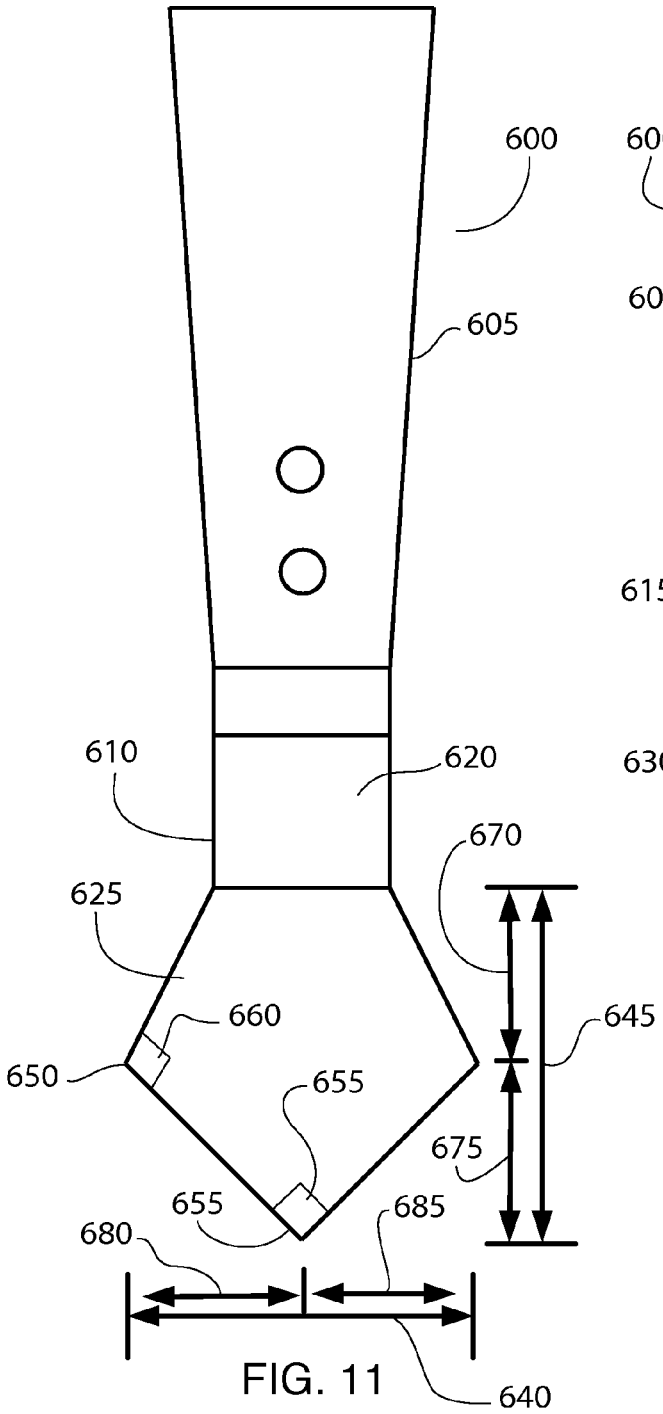
FIGS. 11 and 12 are top and side views, respectively, of a diamond-shaped trowel painting tool.
Figure 12:
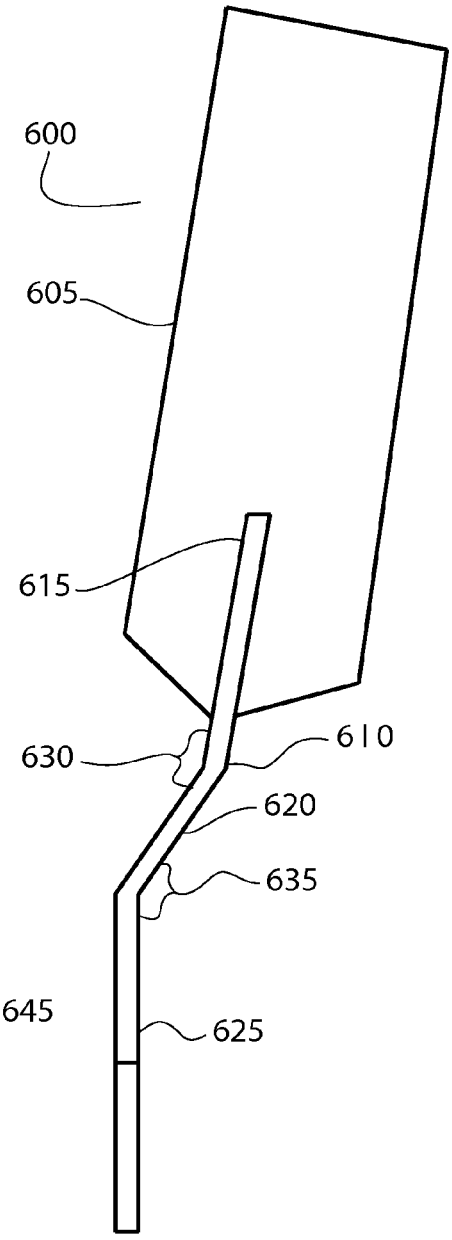

Referring to FIGS. 11 and 12, a diamond-shaped, trowel painting tool 600 is illustrated. The tool 600 includes a handle 605 and a blade 610 having a handle section 615, a middle section 620, and a distal section 625. The handle section 615 extends into the handle 605 approximately half the length of the handle. The middle section 620 of the blade is at an angle 630 to the handle section 615 and the distal section 625 is at an angle 635 to middle section 620. In one implementation, the length of the middle section is approximately 3 cm and forms the angle 630 of between approximately 130 and 150 degrees with the handle section, more particularly between approximately 137 and 143 degree, and even more particularly approximately 140 degrees. The distal section 625 extends from the middle section and is in an almost parallel plane to the handle section and forms the angle 635 of between approximately 110 and 130 degrees with the middle section, more particularly between approximately 115 and 125 degrees, and even more particularly approximately 120 degrees.

In one implementation, the distal section has a width 640 of approximately 5 cm and a length 645 of approximately 7 cm. In another implementation the distal section has a width 640 of approximately 7 cm and a length 645 of approximately 9 cm. Although these dimensions are provided for two implementations, other dimensions are contemplated, such as a width of between approximately 3 cm and 9 cm and a length of between 5 and 11 cm. In general, these dimensions can be varied according to artist preference.

The combination of the angles 630 and 635 between the middle section and the handle and distal sections, and the length of the middle section, offsets the plane containing the handle from the distal section. This offset allows the painter to use the tool on a painting surface with a significantly reduced likelihood of the painter's hands, knuckles, or fingers contacting the painting surface.

The distal section 625 of the blade has two angled corners 650 and a tip 655. The angled corners 650 have an angle 660 and the tip has an angle 665. For example, in one implementation the corners 650 can have an angle 660 in the range of between 110 and 140 degrees, more particularly between approximately 120 and 130 degrees, and most particularly approximately 125 degrees. The angled tip 655 can have an angle in the range of between 60 and 80 degrees, more particularly between approximately 65 and 75 degrees, and most particularly approximately 70 degrees. In another implementation, the corners 650 can have an angle 660 in the range of between 10 and 130 degrees, more particularly between approximately 110 and 120 degrees, and most particularly approximately 115 degrees. The angled tip 655 can have an angle in the range of between 60 and 90 degrees, more particularly between approximately 70 and 80 degrees, and most particularly approximately 75 degrees. The angled corners 650 are used when making strokes on a painting surface and advantageously provide a sharp transition between the paint being manipulated and the adjacent paint. Variations in the angles 660 and 665 of the corners and tip, respectively, will result in a change in a first length 670, a second length 675, a first width 680 and a second width 685.

The distal section 625 can also be varied by the side and distal edge configurations. For example, FIGS. 11 and 12 illustrate the side edges and distal edges each being straight. In other implementations one or both of the distal edges can be serrated, notched, or otherwise fabricated to have different configurations that give an effect when scraping or spreading paint. In particular, a serrated edge is particularly useful in spreading acrylic paints. Similarly, one or both of the side edges can have a serrated edge along a portion of its length, or the entire length. If one or both of the distal edges and one or both of the side edges are serrated, or otherwise fabricated to have a straight edge or different configuration, an artist advantageously can use one tool to create different effects on the painting surface without needing to switch tools.

The tool 600 is particularly useful when working with modeling paste. If using the tool 600 with larger dimensions, it is easy to create knife marks while texturing and when texturing with the smaller dimensions it is easy to avoid creating knife marks. The smaller dimension tool 600 also has been found to be work well with modeling paste to impart texture and depth while reducing the likelihood of leaving scrapings mark. The smaller dimension tool 600 also may be particularly useful when the artist is honing in on specific detail areas or creating for smaller paintings.

Figure 13:
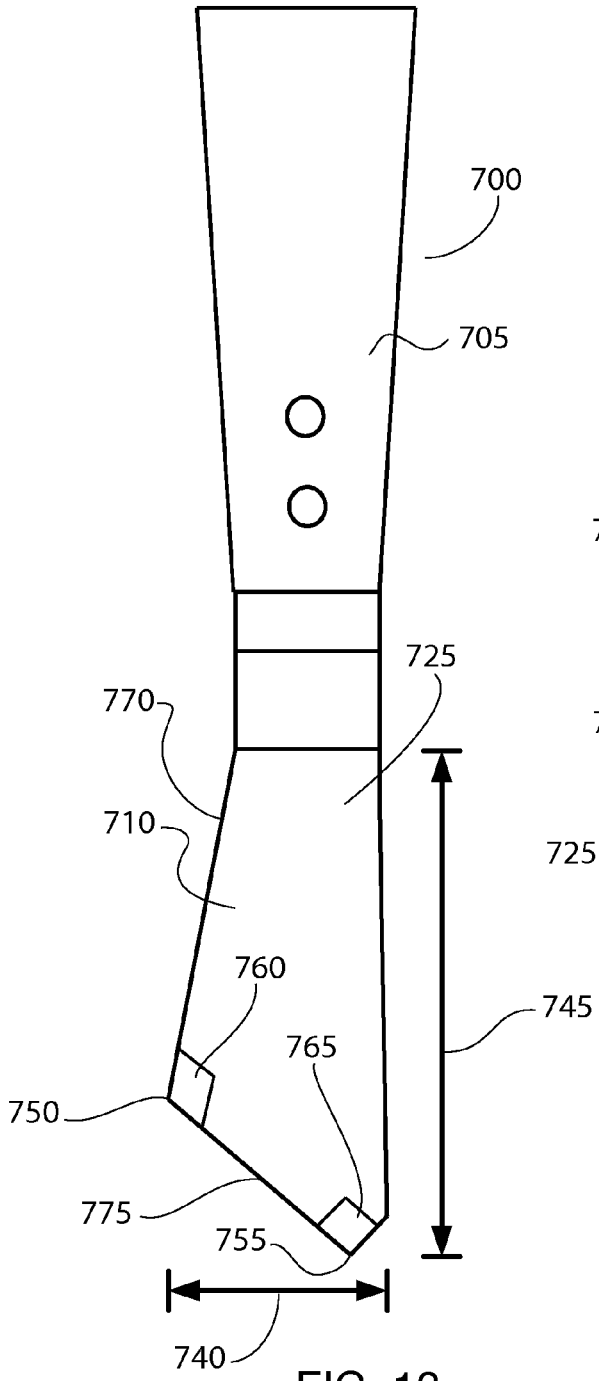
FIGS. 13 and 14 are top and side views, respectively, of a multi-angled trowel painting tool.
Figure 14:
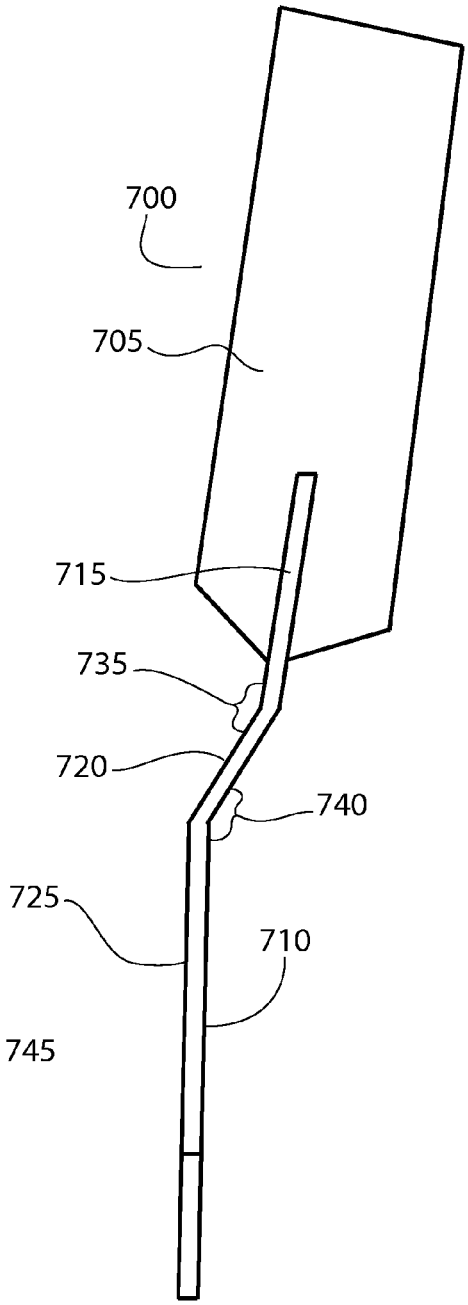

Referring to FIGS. 13 and 14 a multi-angled trowel painting tool 700 is illustrated. The tool 700 includes a handle 705 and a blade 710 having a handle section 715, a middle section 720, and a distal section 725. The handle section 715 extends into the handle 705 approximately half the length of the handle. The middle section 720 of the blade is at an angle 730 to the handle section 715 and the distal section 725 is at an angle 735 to middle section 720. In one implementation, the length of the middle section is approximately 3 cm and forms the angle 730 of between approximately 130 and 150 degrees with the handle section, more particularly between approximately 137 and 143 degree, and even more particularly approximately 140 degrees. The distal section 725 extends from the middle section and is in an almost parallel plane to the handle section and forms the angle 735 of between approximately 110 and 130 degrees with the middle section, more particularly between approximately 115 and 125 degrees, and even more particularly approximately 120 degrees.

In one implementation, the distal section expands to a width 740 of approximately 3.5 cm and a length 745 of approximately 10 cm. In another implementation the distal section has a width 740 of approximately 5.5 cm and a length 745 of approximately 12 cm. Although these dimensions are provided for two implementations, other dimensions are contemplated, such as a width of between approximately 2 cm and 7 cm and a length of between approximately 5 and 15 cm. In general, these dimensions can be varied according to artist preference.

The combination of the angles 730 and 735 between the middle section and the handle and distal sections, and the length of the middle section, offsets the plane containing the handle from the distal section. This offset allows the painter to use the tool on a painting surface with a significantly reduced likelihood of the painter's hands, knuckles, or fingers contacting the painting surface.

The distal section 725 of the blade has an angled corner 750 and a tip 755. The angled corner 750 has an angle 760 and the tip has an angle 765. For example, in one implementation the corner 750 can have an angle 760 in the range of between 125 and 145 degrees, more particularly between approximately 130 and 140 degrees, and most particularly approximately 135 degrees. The corner 755 can have an angle 765 in the range of between 85 and 95 degrees, more particularly between approximately 87 and 93 degrees, and most particularly approximately 90 degrees. In another implementation the corner 750 can have an angle 760 in the range of between 105 and 125 degrees, more particularly between approximately 110 and 120 degrees, and most particularly approximately 115 degrees. The corner 755 can have an angle 765 in the range of between 90 and 100 degrees, more particularly between approximately 92 and 98 degrees, and most particularly approximately 95 degrees.

The angled corner 750 is used when making strokes on a painting surface and advantageously provides a sharp transition between the paint being manipulated and the adjacent paint. Variations in the angles 760 and 765 of the corners and tip, respectively, will result in a change in a first length 770, a second length 775, and the width 740.

The distal section 725 can also be varied by the side and distal edge configurations. For example, FIGS. 13 and 14 illustrate the side edges and distal edges each being straight. In other implementations one or both of the distal edges can be serrated, notched, or otherwise fabricated to have different configurations that give an effect when scraping or spreading paint. In particular, a serrated edge is particularly useful in spreading acrylic paints. Similarly, one or more of the side edges can have a serrated edge along a portion of its length, or the entire length. If one or both of the distal edges and one or more of the side edges are serrated, or otherwise fabricated to have a straight edge or different configuration, an artist advantageously can use one tool to create different effects on the painting surface without needing to switch tools. If each different edge has a different configuration, then the artist has more versatility in painting techniques with using only one tool.

Figure 15:
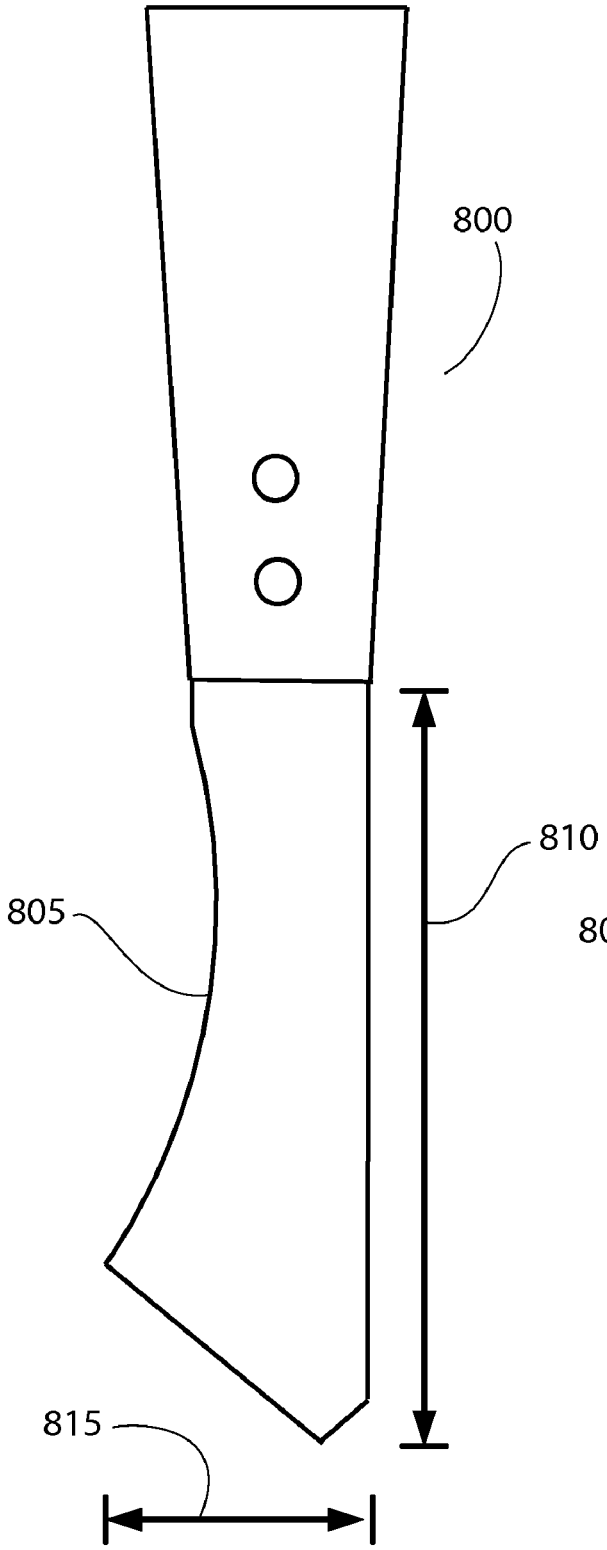
FIGS. 15 and 16 are top and side views, respectively, of a scythe-shaped trowel painting tool.
Figure 16:
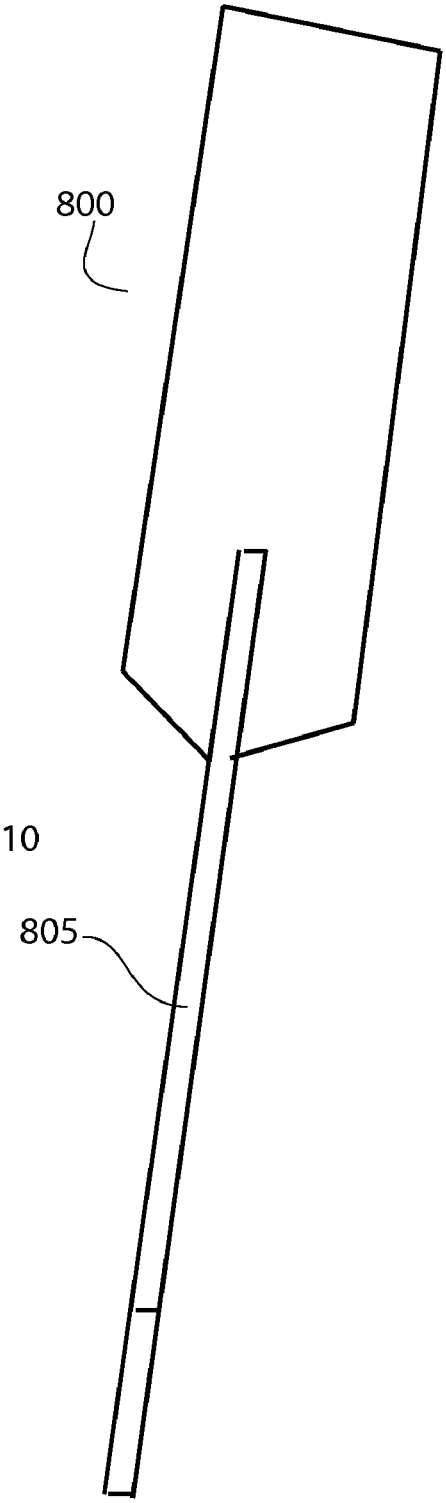

Modifications of the multi-angled trowel painting tool 700 are contemplated. For example, referring to FIGS. 15 and 16, a scythe-shaped trowel painting tool 800 is similar to the multi-angled trowel painting tool 700 except for two changes: the blade is within a single plane and one straight edge of the tool 700 is replaced by a curved, scythe-like edge 805. A length 810 of the blade can vary from approximately 10 cm to 16 cm, more particularly approximately 13 to 14 cm, and even more particularly 13.5 cm. A width 815 of the blade can vary from approximately 3 cm to 6 cm, more particularly 4 cm to 5 cm, and even more particularly 4.5 cm. This tool offers the advantages that the artist is able to use all sides of the blade to create different lines and marks and each side has a varying length. As a consequence of these design factors, the tool is essentially three knives in one. It should be noted that the modifications described above with respect to tool 700 are equally applicable to the scythe-shaped trowel painting tool.

Figure 17:
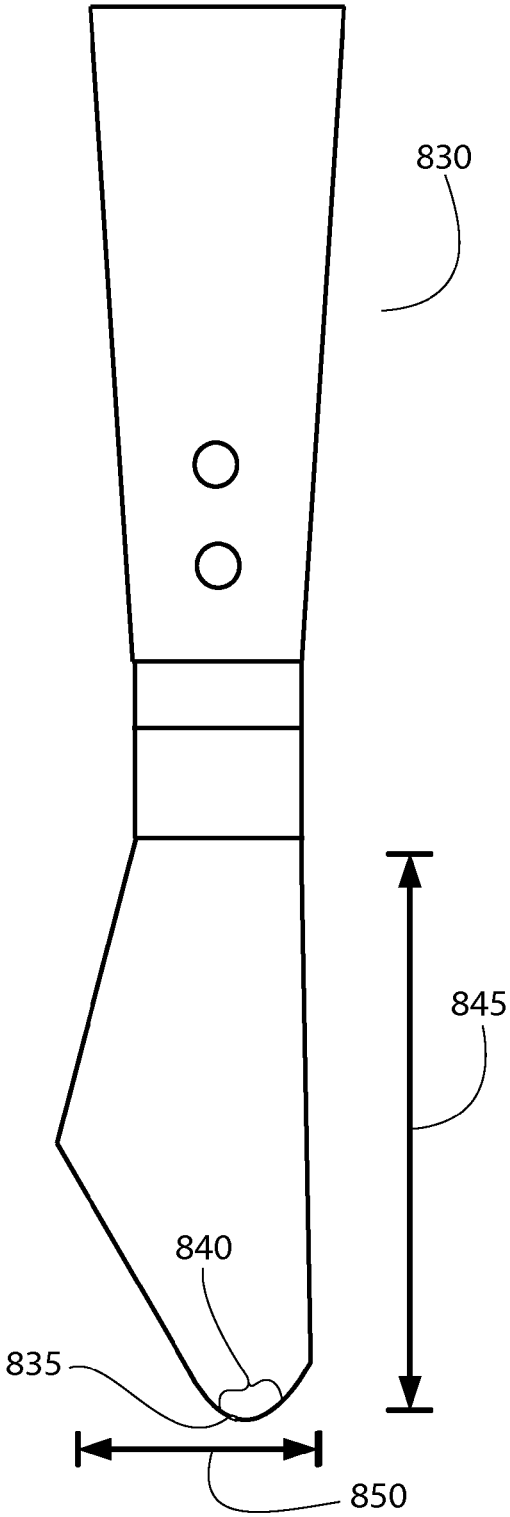
FIGS. 17 and 18 are top and side views, respectively, of a multi-angled, rounded tip trowel painting tool.
Figure 18:
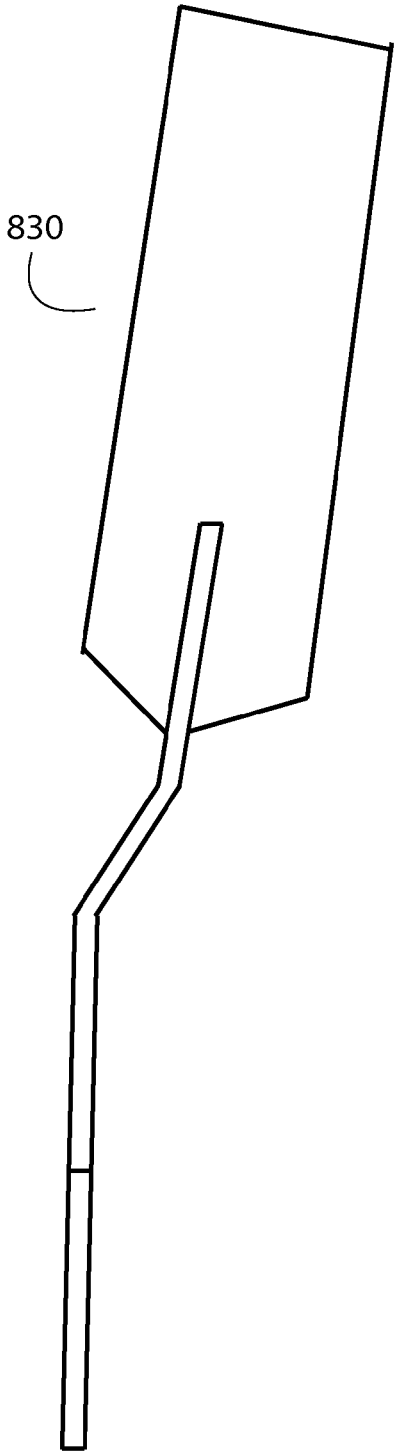

Referring to FIGS. 17 and 18, in another modification of the multi-angled trowel painting tool 700, a multi-angled, rounded tip trowel painting tool 830 differs from the tool 700 by the tip 835. Rather than having an angled, sharp tip, the tip 835 is rounded with a radius 840. The radius can vary between 1 and 2 cm, more particularly 1.3 to 1.7 cm, and even more particularly 1.5 cm. A length 845 of the blade can vary from approximately 15 cm to 20 cm, more particularly approximately 17 to 18 cm, and even more particularly 17.5 cm. A width 850 of the blade can vary from approximately 2.5 cm to 4.5 cm and more particularly 3.5 cm. This tool offers the advantages that the blade gives a lot of flexibility to an artist to use the knife to carry paint, spread paint, and make creative marks with the blade. It again should be noted that the modifications described above with respect to tool 700 are equally applicable to the multi-angled, rounded tip trowel painting tool 830.

Figure 19:
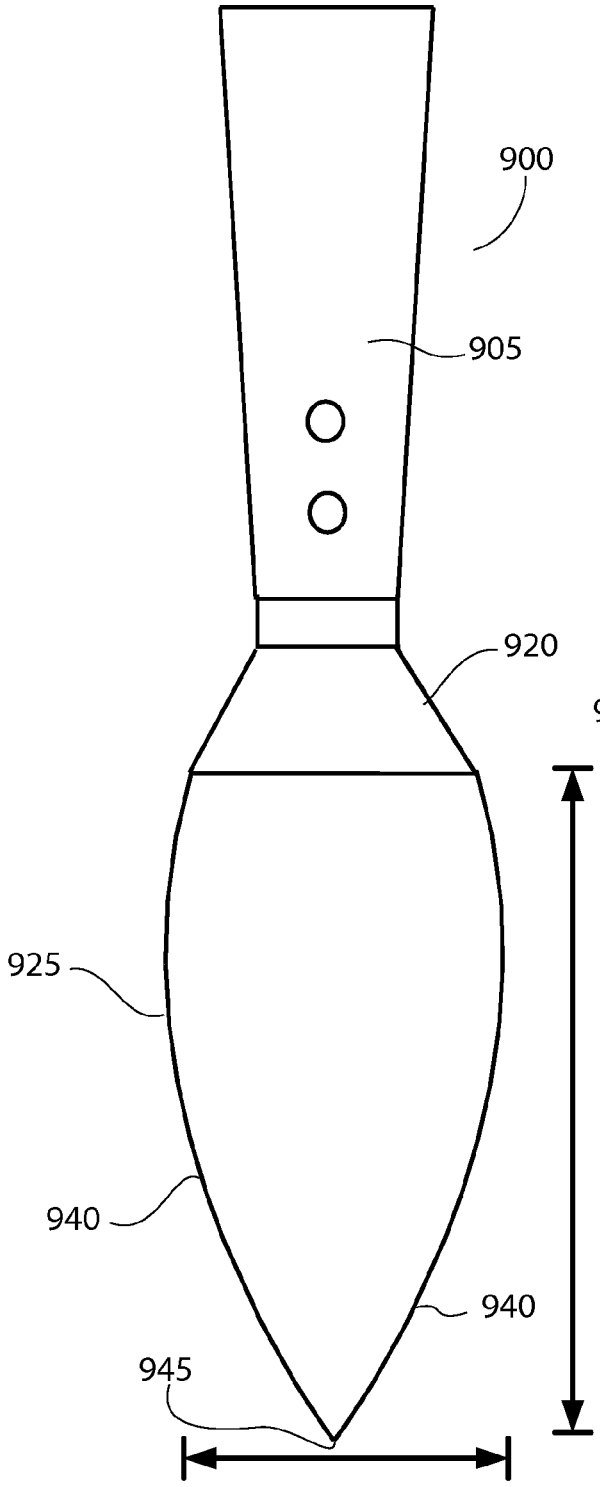
FIGS. 19 and 20 are top and side views, respectively, of an oval, sharp-tipped trowel painting tool.
Figure 20:
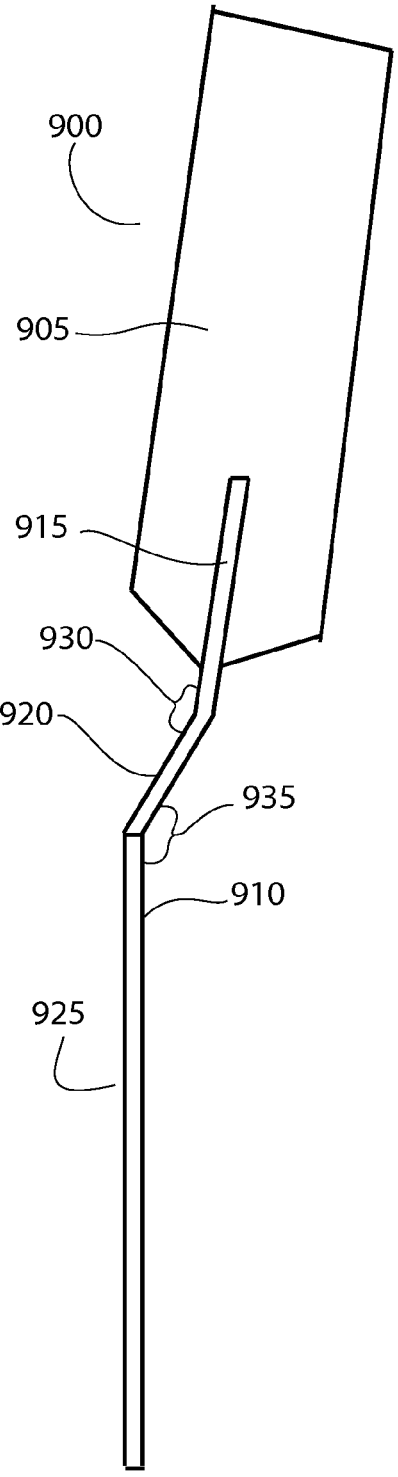

Referring to FIGS. 19 and 20, an oval, sharp-tipped trowel painting tool 900 is illustrated. The tool 900 includes a handle 905 and a blade 910 having a handle section 915, a middle section 920, and a distal section 925. The handle section 915 extends into the handle 905 approximately half the length of the handle. The middle section 920 of the blade is at an angle 930 to the handle section 915 and the distal section 925 is at an angle 935 to middle section 920. In one implementation, the length of the middle section is approximately 3 cm and forms the angle 930 of between approximately 130 and 150 degrees with the handle section, more particularly between approximately 137 and 143 degrees, and even more particularly approximately 140 degrees. The distal section 925 extends from the middle section and is in an almost parallel plane to the handle section and forms the angle 935 of between approximately 110 and 130 degrees with the middle section, more particularly between approximately 115 and 125 degrees, and even more particularly approximately 120 degrees.

In one implementation, the distal section has a width of approximately 6.5 cm and a length of approximately 12 cm. In other implementations, the distal section has a width that varies between approximately 4 cm and 9 cm and a length that varies between approximately 10 cm and 14 cm, depending upon artist preference and need.

The combination of the angles 930 and 935 between the middle section and the handle and distal sections, and the length of the middle section, offsets the plane containing the handle from the distal section. This offset allows the painter to use the tool on a painting surface with a significantly reduced likelihood of the painter's hands, knuckles, or fingers contacting the painting surface.

The distal section 925 of the blade has two sides 940 that form an oval shape and meet to form a sharp, pointed tip 945. The distal section 925 can be varied by side edge configurations. For example, FIGS. 19 and 20 illustrate the side edges each being straight. In other implementations the side edge can be serrated, notched, or otherwise fabricated to have different configurations that give an effect when scraping or spreading paint. In particular, a serrated edge is particularly useful in spreading acrylic paints. Similarly, one or both of the side edges can have a serrated edge along a portion of its length, or the entire length. If the one of the side edges are serrated, or otherwise fabricated to have a straight edge or different configuration, an artist advantageously can use one tool to create different effects on the painting surface without needing to switch tools. In addition, as a result of the flexible blade, the tool has the ability to pick up a relatively enhanced quantity of paint and spread it over a large amount of surface area.

While several particular forms of the invention have been illustrated and described, it will be apparent that various modifications and combinations of the invention detailed in the text and drawings can be made without departing from the spirit and scope of the invention. For example, references to materials of construction, methods of construction, specific dimensions, shapes, utilities or applications are also not intended to be limiting in any manner and other materials and dimensions could be substituted and remain within the spirit and scope of the invention. Accordingly, it is not intended that the invention be limited, except as by the appended claims.

What is claimed is:

1. A method of painting with acrylic paint to provide a sharp transition between an acrylic painting material being manipulated on a painting surface and an adjacent acrylic painting material on the painting surface, the method comprising:

providing a painting tool, the painting tool comprising a handle and a blade, the blade being of a resilient metal material, having a matted surface, and including a handle section, a middle section, and a distal section, wherein the handle section has a first end and a second end, the first end being positioned within the middle third of the length of the handle and the second end being connected to the middle section, the middle section having a longitudinal axis and connecting at a first end to the handle section and forming an angle of between approximately 130 and 150 degrees with a longitudinal axis of the handle section and connecting at a second end to the distal section and forming an angle of between approximately 110 and 130 degrees with a longitudinal axis of the distal section, and the distal section being defined by three edges, a first edge of the distal section extending from a first edge of the middle section, a second edge of the distal section extending from a second edge of the middle section, and a third edge of the distal section extending from the first edge of the distal section to the second edge of the distal section to form a sharp angled corner with the first edge of the distal section, wherein the sharp angled corner has an angle of between 125 and 145 degrees and wherein the third edge of the distal section includes a straight portion that forms the sharp angled corner with the first edge of the distal section and a rounded tip adjacent to the second edge of the distal section;

using the middle section or distal section, or both to take the acrylic painting material and place the acrylic painting material onto the painting surface, and manipulating the painting material on the painting surface with one of the rounded tip and the sharp angled corner of the distal section of the painting tool such that the sharp angled corner associated with the edge is used provide a sharp transition between the acrylic painting material being manipulated on the painting surface and an adjacent acrylic painting material on the painting surface, whereby the matted surface of the blade prevents glare.

2. The method of painting of claim 1, wherein manipulating the acrylic painting material on the painting surface comprises one or more of scraping, scumbling, mixing, sculpting, spreading, sgraffito, dragging, linework, incising, and scratching.

3. The method of painting of claim 1, wherein using the painting tool to take the acrylic painting material and place the acrylic painting material onto the painting surface further comprises placing one or more of wet paint, dry paint, wet gels, dry gels, aggregates, wet plaster, and dry plaster on the painting surface.

4. The method of painting of claim 1, the method further comprising using the rounded tip to provide a smooth transition between the acrylic paint being manipulated and the painting surface.

5. The method of claim 1, wherein the distal section has a serrated edge, the method further comprising using the serrated edge to provide a textured surface to the acrylic paint on the painting surface.

* * * * *